US010794580B1

(12) United States Patent
Su et al.

(10) Patent No.: US 10,794,580 B1
(45) Date of Patent: Oct. 6, 2020

(54) WATERPROOF LIGHTING FIXTURE WITH INTERCONNECTION PORTS

(71) Applicants: Chung Jen Su, Kaohsiung (TW); Jyh Huei Lay, Kaohsiung (TW); Kuan Ling Tseng, Kaohsiung (TW)

(72) Inventors: Chung Jen Su, Kaohsiung (TW); Jyh Huei Lay, Kaohsiung (TW); Kuan Ling Tseng, Kaohsiung (TW)

(73) Assignee: VM5 LIGHTING SOLUTIONS, LLC, Ontario, CA (US)

( * ) Notice: Subject to any disclaimer, the term of this patent is extended or adjusted under 35 U.S.C. 154(b) by 0 days.

(21) Appl. No.: 16/595,184

(22) Filed: Oct. 7, 2019

(51) Int. Cl.

| | |
|---|---|
| ***F21V 15/01*** | (2006.01) |
| ***F21V 23/06*** | (2006.01) |
| ***F21V 21/005*** | (2006.01) |
| ***F21V 31/00*** | (2006.01) |
| *F21Y 115/10* | (2016.01) |
| *F21Y 103/10* | (2016.01) |

(52) U.S. Cl.
CPC ..... *F21V 23/06* (2013.01); *F21V 21/005* (2013.01); *F21V 31/005* (2013.01); *F21Y 2103/10* (2016.08); *F21Y 2115/10* (2016.08)

(58) Field of Classification Search
CPC ..... F21V 15/01; F21V 15/013; F21V 21/025; F21V 23/06; E21Y 2103/10; F21Y 2105/10; F21Y 2103/10; F21S 4/28
See application file for complete search history.

(56) References Cited

U.S. PATENT DOCUMENTS

| | | | | |
|---|---|---|---|---|
| 5,521,805 | A * | 5/1996 | Lim | F21V 19/008 362/217.08 |
| 5,658,067 | A * | 8/1997 | Engle | F21S 2/00 362/219 |
| 6,536,924 | B2 * | 3/2003 | Segretto | F21S 2/005 362/247 |
| 6,726,348 | B2 * | 4/2004 | Gloisten | B64D 11/00 362/372 |
| 7,513,640 | B2 * | 4/2009 | Hendrikus | H01R 33/08 362/219 |
| 7,810,955 | B2 * | 10/2010 | Stimac | F21V 23/005 362/294 |
| 7,850,341 | B2 * | 12/2010 | Mrakovich | G02B 6/001 362/235 |
| 7,871,180 | B2 * | 1/2011 | Wu | F21S 2/00 362/217.13 |
| 8,104,920 | B2 * | 1/2012 | Dubord | F21S 2/005 362/217.12 |
| 8,287,144 | B2 * | 10/2012 | Pedersen | F21S 4/28 362/217.01 |
| 10,352,510 | B2 * | 7/2019 | Van Winkle | F21S 2/00 |

(Continued)

*Primary Examiner* — Ismael Negron
(74) *Attorney, Agent, or Firm* — Che-Yang Chen; Law Office of Michael Chen

(57) ABSTRACT

A lighting fixture includes an elongated main body with side covers and housing power supply, a waterproof part, a base attached to the waterproof part opposite the main body and having a lamp panel, a translucent cover attached to the base to cover the lamp panel, a quick plug port provided at one end of the main body, and first and second ports provided at another end of the main body. The first port is electrically connected to the power supply, while the second port is configured to be coupled to an external power source or to the quick plug port of a second lighting fixture.

13 Claims, 14 Drawing Sheets

(56) References Cited

U.S. PATENT DOCUMENTS

| | | | | |
|---|---|---|---|---|
| 10,598,362 | B2 * | 3/2020 | Xue | F21V 23/002 |
| 2002/0044456 | A1 * | 4/2002 | Balestriero | F21V 17/101<br>362/555 |

* cited by examiner

WATERPROOF LIGHTING FIXTURE WITH INTERCONNECTION PORTS

FIELD OF THE INVENTION

The present invention relates to a linear lighting fixture, more particularly to the linear lighting fixture capable of completing the installation quickly by a quick plug connector, and the linear lighting fixture has an aluminum extruded waterproof component.

BACKGROUND OF THE INVENTION

1. Description of the Related Art

With the advancement of technology and the improvement of life quality, modern decorations are introduced constantly, and the form of expression and the demand of light sources receive increasing attention. In recent years, the light source of a light emitting diode (LED) having the features of quick response, small volume, low power consumption, and long service life is developed rapidly and gradually replaces traditional fluorescent lamps, commercial lighting, and decorative lighting, and further provides a more diversified representation of the light source.

For the linear lighting fixtures which gradually replaces fluorescent lamps, using a primary optical design to convert a dot light source into a linear light source is just a prior art, and an aluminum extruded main body with a trunking is generally provided for receiving a power supply and an LED lamp panel and working together with a translucent cover to provide a linear light source. However, the traditional linear lighting fixture still has the issues of connecting a light fixture to another light fixture inconveniently, failing to continue the light source, and failing to resist water from entering in the trunking, etc.

To overcome the aforementioned drawbacks, P.R.C. Pat. Publication No. CN106195692A discloses an "edge-free embedded and seamlessly connected LED strip light" comprising a light source module with a pre-embedded element of an installing member, a diffusion plate, an aluminum substrate, a lamp body, a fastener, and a male connection installed to the light source module, and the lamp body has symmetrical plastic strips disposed on the inner side of the lamp body, and a light source is installed at the aluminum substrate, so that the surface of the installed light source module has no frame, and thus the light source can be extended unlimitedly. This patented technology can overcome the drawback of the conventional LED strip lamp with a frame exposed to the outside, which in turn creating an obvious frame or an obvious gap between the strip lamps.

In addition, U.S. Pat. No. 10,125,964B2 discloses a linear light connector comprising at least one electrical contact extending in the lengthwise direction of a base of the connector, a plurality of pointed ends formed on the electrical contact and aligned precisely with the electrical conduction path of the linear light source, wherein the sharp ends are passed through an opening of the connector and then contacted with the electrical conduction path of a circuit board, and the method of extending the electrical contact is used to increase the length of the linear light source and overcome the drawback of the conventional linear lights that has a gap between two adjacent linear lights.

2. Summary of the Invention

In the conventional linear lighting fixtures, when a light fixture is connected with another light fixture, the following problem arises. The connected linear lighting fixtures cannot continue the light source and cannot resist water from entering into the trunking. Obviously, the conventional linear lighting fixtures require improvements.

Therefore, it is a primary objective of the present invention to improve the waterproof performance of the interior of the trunking by using a waterproof part embedded between a base and a main body of the light fixture.

Another objective of the present invention is to form a freely connected port on a side over of the trunking of a light fixture body, so that a light fixture and another light fixture can be connected to each other quickly by a quick plug connector to improve the efficiency of installing and connecting the light fixtures.

To achieve the aforementioned objective, the present invention discloses a quick plug linear lighting fixture, comprising: a main body and a translucent cover, both having a trunking and embedded and installed to upper and lower ends of a base respectively, and the trunking of the main body having a power supply contained therein, and an end surface of the base facing the translucent cover having a lamp panel, and both ends of the main body having a first side cover secured by a locking element, and a second side cover disposed at both ends of the translucent cover separately and secured by a locking element, characterized in that a waterproof part is embedded and fixed to an opening of the trunking, a first sealing strip is installed and filled between both outer sides of the waterproof part and the main body separately, a second sealing strip installed and filled to both ends where the base and the translucent cover are engaged, a quick plug port is formed on one of the first side covers, a first port and a second port are formed on another first side cover, the first port is electrically coupled to the power supply and the lamp panel by a first connector, and the second port is coupled to an external power supply by a second connector or coupled to a quick plug port of the other linear lighting fixture by a quick plug connector, so as to assemble and connect the linear lighting fixture with the other linear lighting fixture quickly.

DESCRIPTION OF THE PREFERRED EMBODIMENTS

The above and other objects, features and advantages of this disclosure will become apparent from the following detailed description taken with the accompanying drawings.

Figure 1:
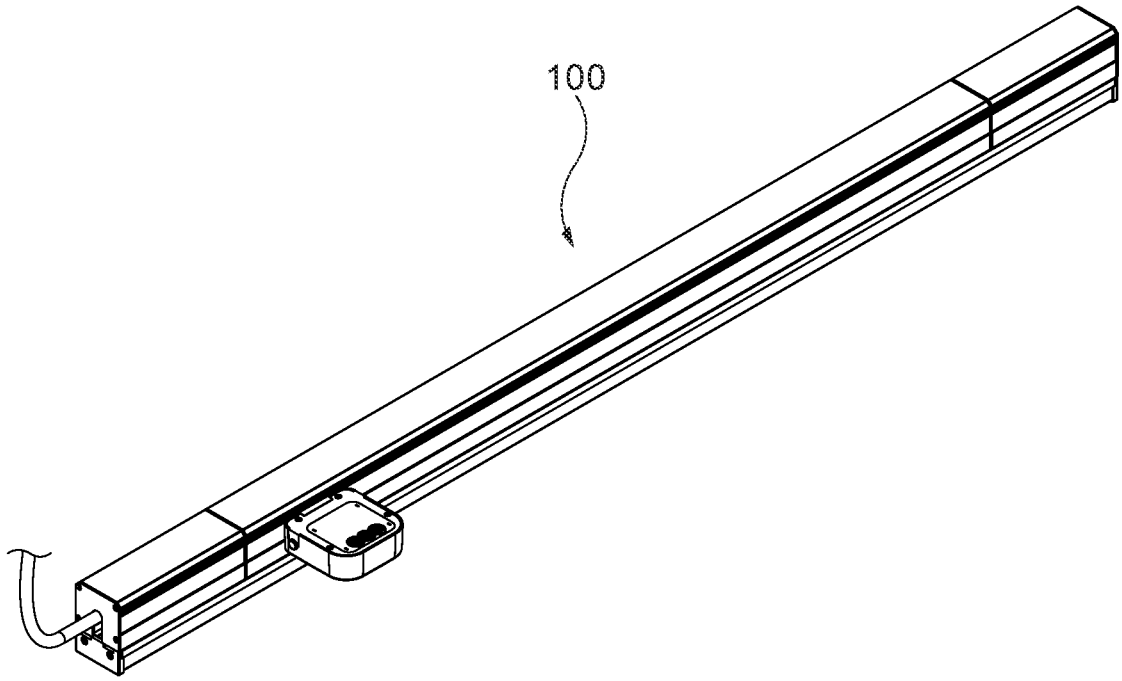
FIG. 1 is a perspective view of the present invention.
Figure 2:
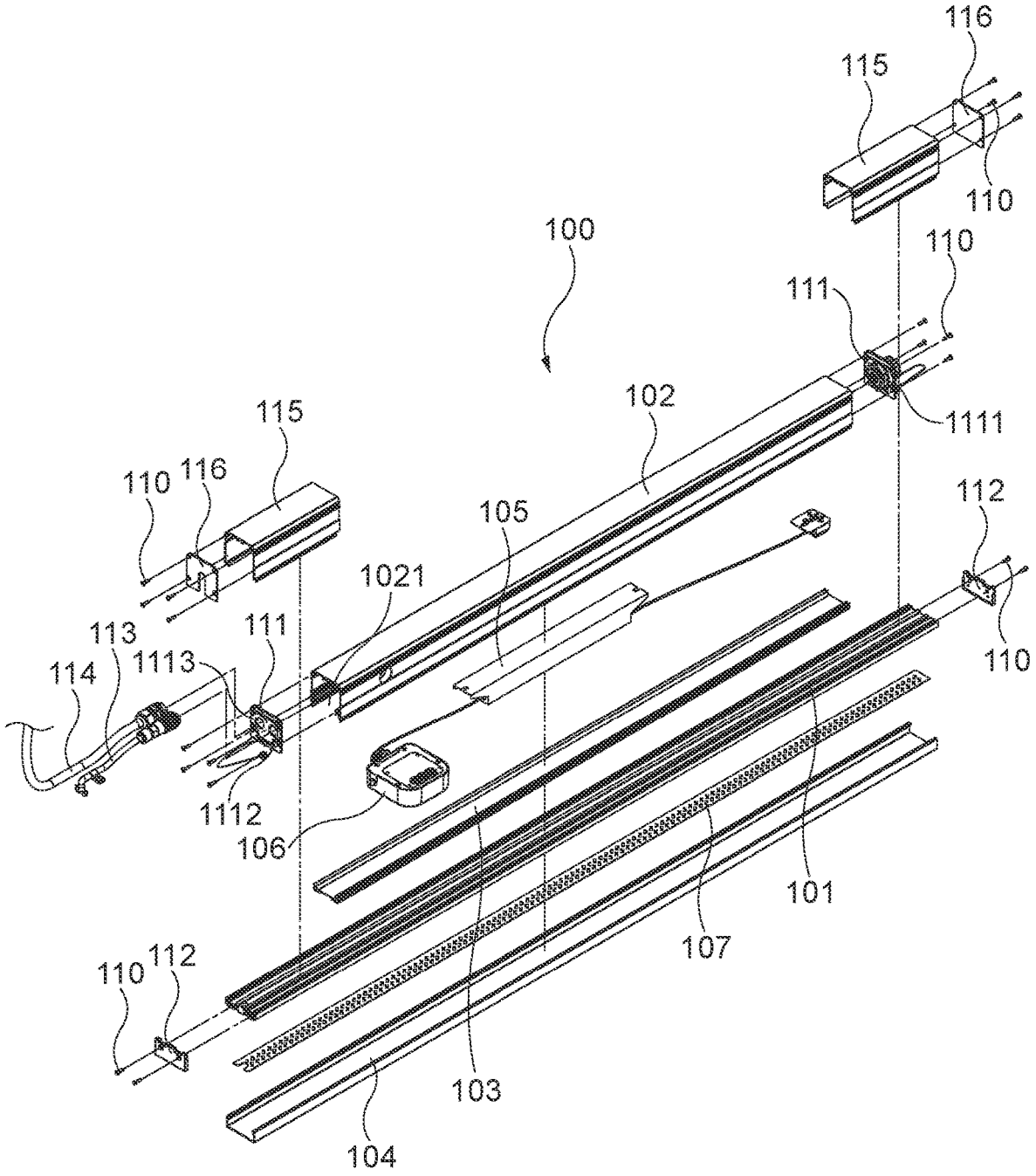
FIG. 2 is an exploded view of the present invention.
Figure 3:
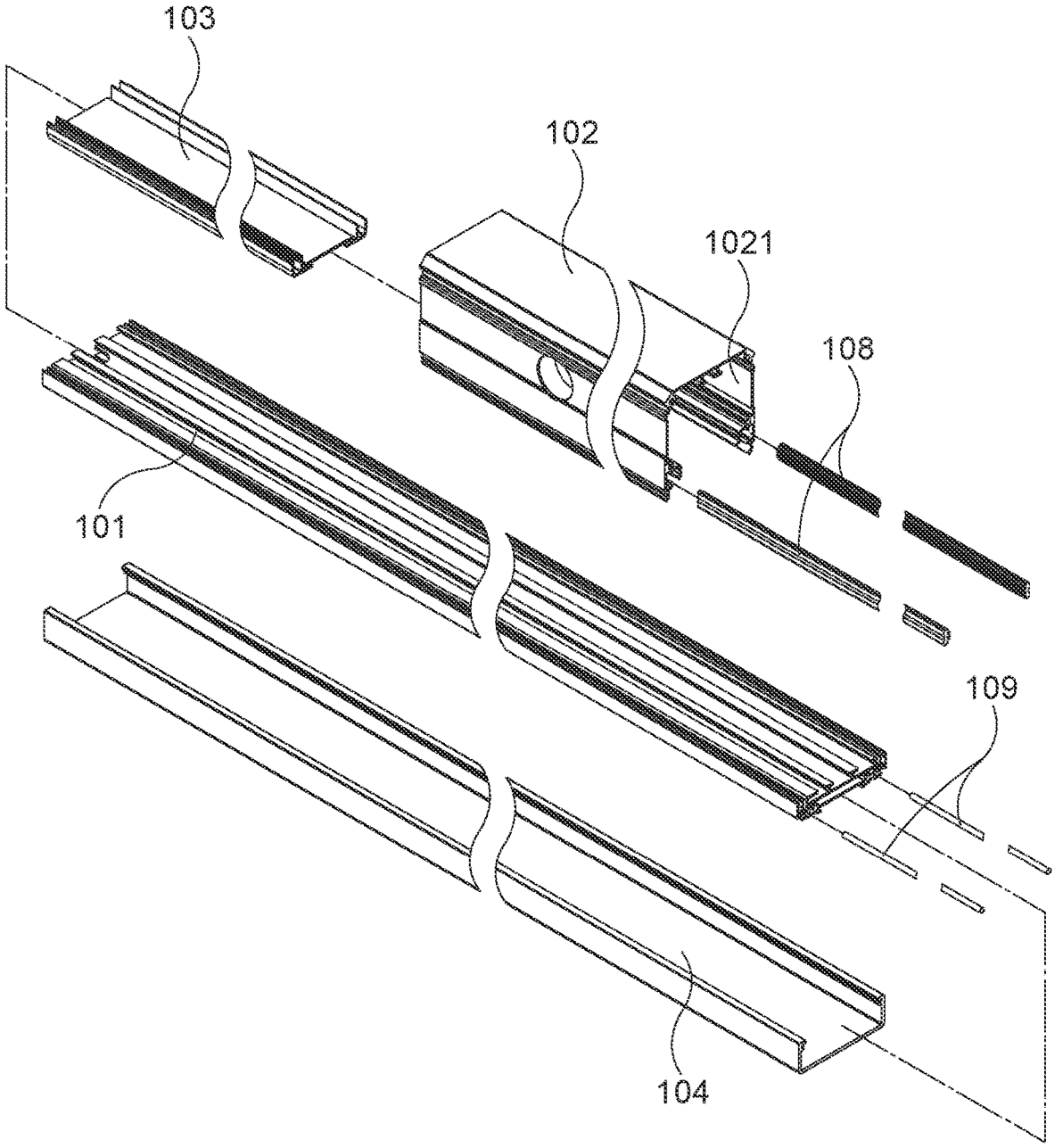
FIG. 3 is an exploded view of a waterproof structure of the present invention.
Figure 4:
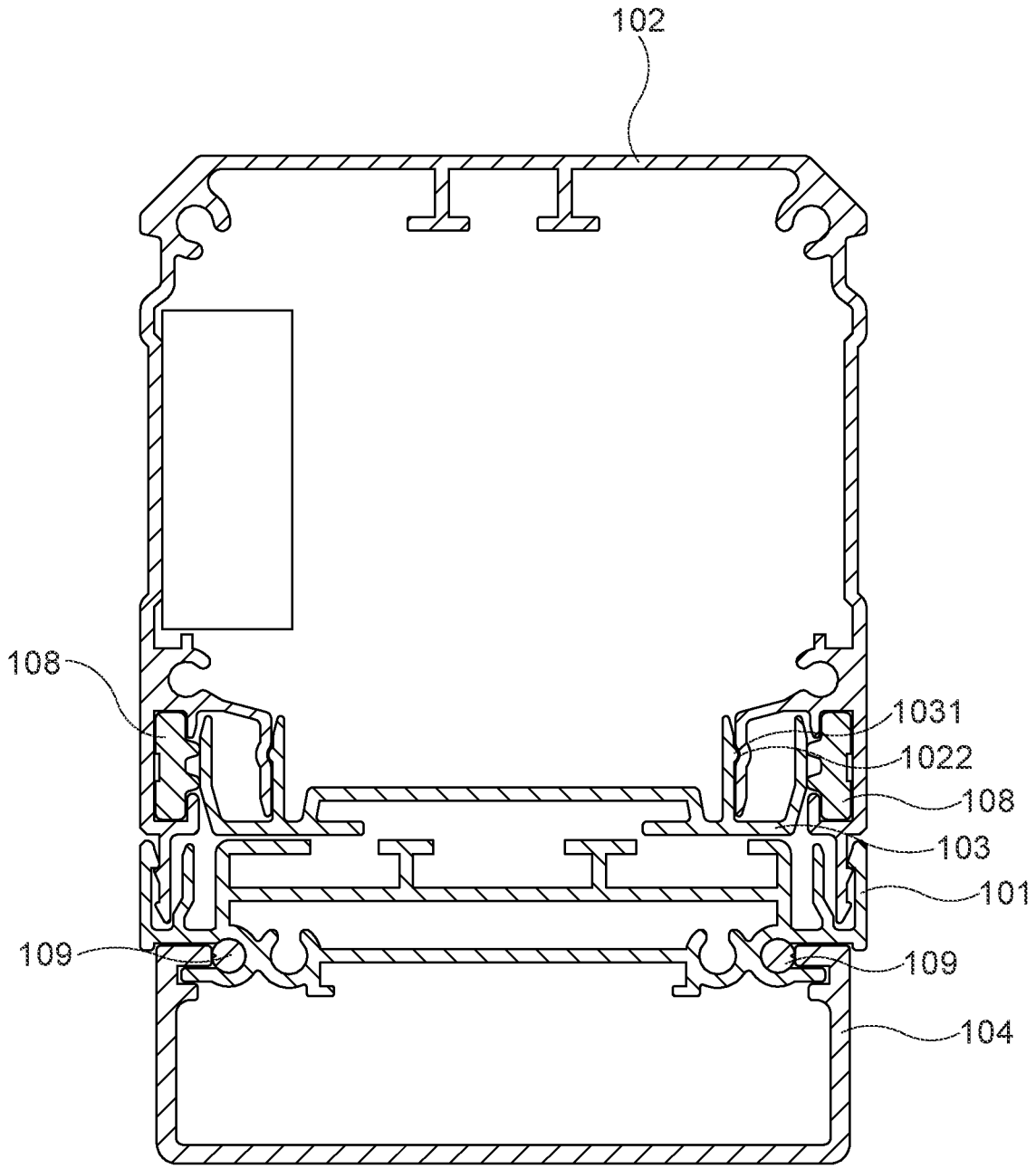
FIG. 4 is a cross-sectional view of a waterproof structure of the present invention.
Figure 5:
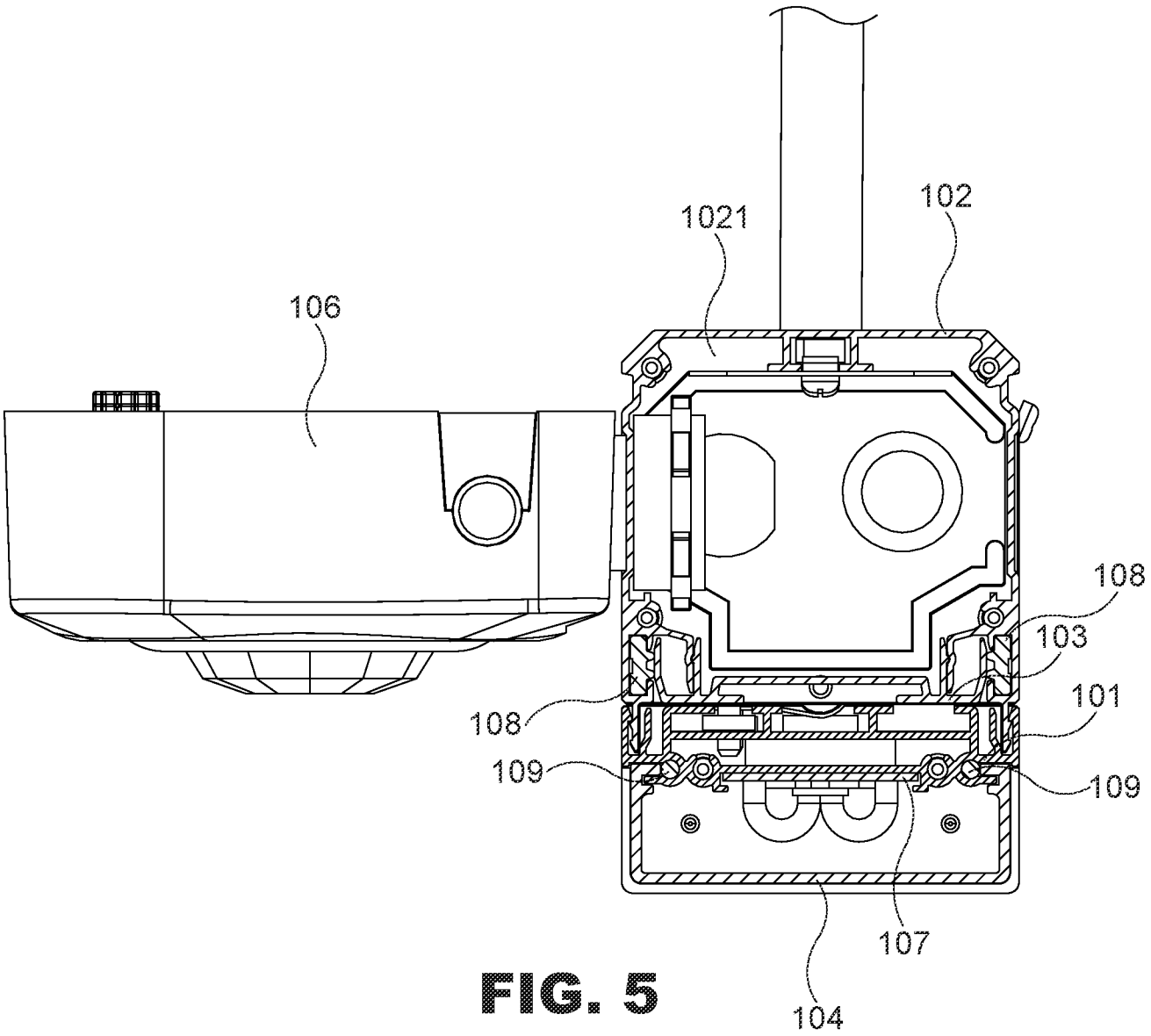
FIG. 5 is a cross-sectional view of the present invention.

With reference to FIGS. 1-2 for a linear lighting fixture 100 of the present 10 invention, the linear lighting fixture 100 comprises a base 101, a main body 102, a waterproof part 103, a translucent cover 104, a power supply 105, a sensor 106 and a lamp panel 107. A main body 102 and a translucent cover 104 are embedded and assembled to both upper and lower ends of the base 101 respectively (refer to FIG. 3 as well), and a trunking 1021 is formed at main body 102, and a power supply 105 disposed in the trunking 1021 and electrically coupled to a sensor 106, and a lamp panel is mounted on an end surface of the base 101 facing the translucent cover 104. Preferably, the lamp panel 107 is an LED lamp panel. The waterproof part 103 is embedded into an opening of the trunking 1021. Preferably, the waterproof part 103 is aluminum extruded, and the contact surface of the main body 102 and the waterproof part 103 is formed into a concave arc 1022 (refer to FIG. 4 as well), and a rib 1031 is disposed at the waterproof part 103 and configured to be corresponsive to the concave arc 1022, so that the waterproof part 103 and the main body 102 can be engaged with each other correspondingly. A first sealing strip 108 is installed and filled between both outer sides of the waterproof part 103 and the main body 102 separately, and a second sealing strip 109 is installed and filled to both ends where the base 101 and the translucent cover 104 are engaged, and a first side cover 111 is fixed to both ends of the main body 102 separately by a locking element 110, and a second side cover 112 is fixed to both ends of the translucent cover 104 separately by a locking element 110, so that when the power supply 105 is contained in the trunking 1021, the waterproof part 103, the first sealing strip 108 and the second sealing strip 109 are provided to achieve the waterproof effect (as shown in FIG. 5).

A quick plug port 1111 is formed on one of the first side covers 111, and a first port 1112 and a second port 1113 are formed on the other first side cover 111, so that the first port 1112 can be respectively and electrically coupled to the power supply 105 and the lamp panel 107 by a first connector 113, and the second port 1113 can be coupled to an external power supply by a second connector 114 to complete the electrical conduction and connection of the linear lighting fixture 100. In addition, the first port 1112, the second port 1113 and the quick plug port 1111 of the first side cover 111 are covered by an external cover 115, and an end cover 116 is fixed to a port of the external cover 115 which has not been connected to the main body 102 by a locking element 110.

Figure 6:
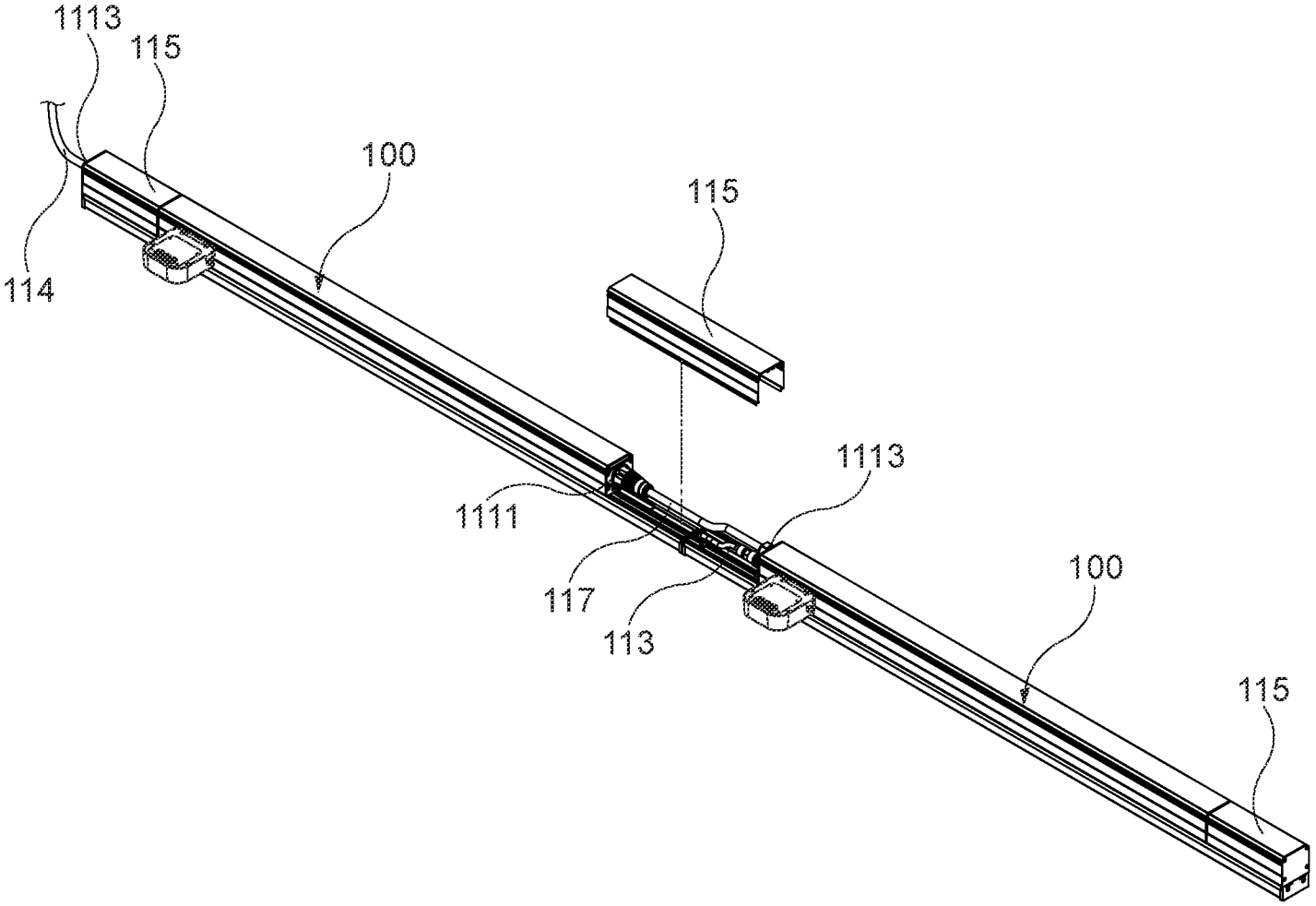
FIG. 6 is a schematic view of a first assembly in accordance with an embodiment of the present invention.

With reference to FIG. 6 for a first assembly in accordance with an embodiment of the present invention, at least two sets of linear lighting fixtures 100 are assembled and connected, and the second port 1113 of one of the sets of linear lighting fixtures 100 is coupled to the second connector 114 of the external power, and the quick plug port 1111 is coupled to the second port 1113 of another set of linear lighting fixture 100 by the quick plug connector 117, so that the electric power of the two sets of linear lighting fixtures 100 are conducted to show an I-shape light source.

Figure 7:
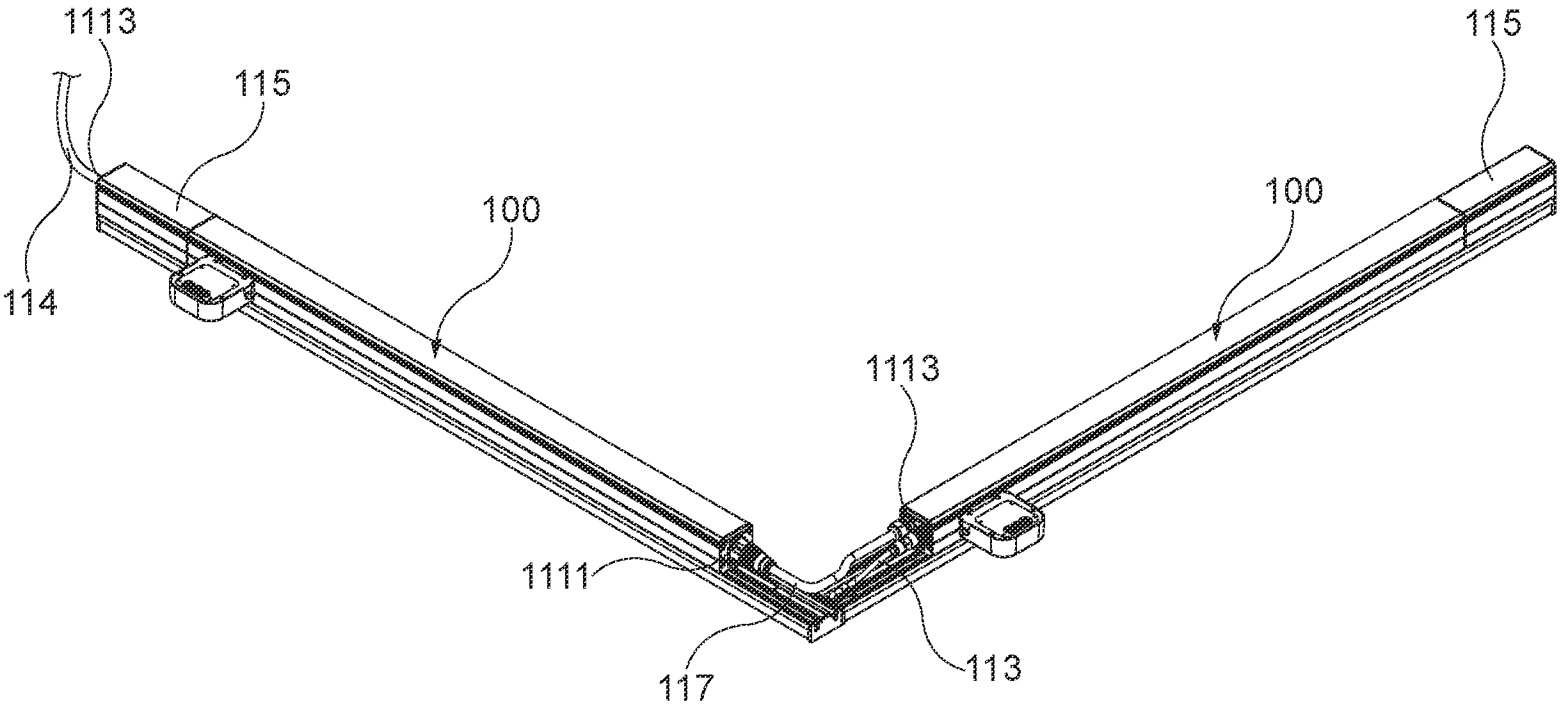
FIG. 7 is a schematic view of a second assembly in accordance with an embodiment of the present invention.

With reference to FIG. 7 for a second assembly in accordance with an embodiment of the present invention, at least two sets of linear lighting fixtures 100 are assembled and coupled in the vertical direction, and the second port 1113 of one set of linear lighting fixture 100 is coupled to the second connector 114 of an external power, and the quick plug port 1111 is coupled to the second port 1113 of another set of linear lighting fixture 100 by the quick plug connector 117 to conduct the electrical power of the two sets of linear lighting fixtures 100, so as to show an L-shaped light source.

Figure 8:
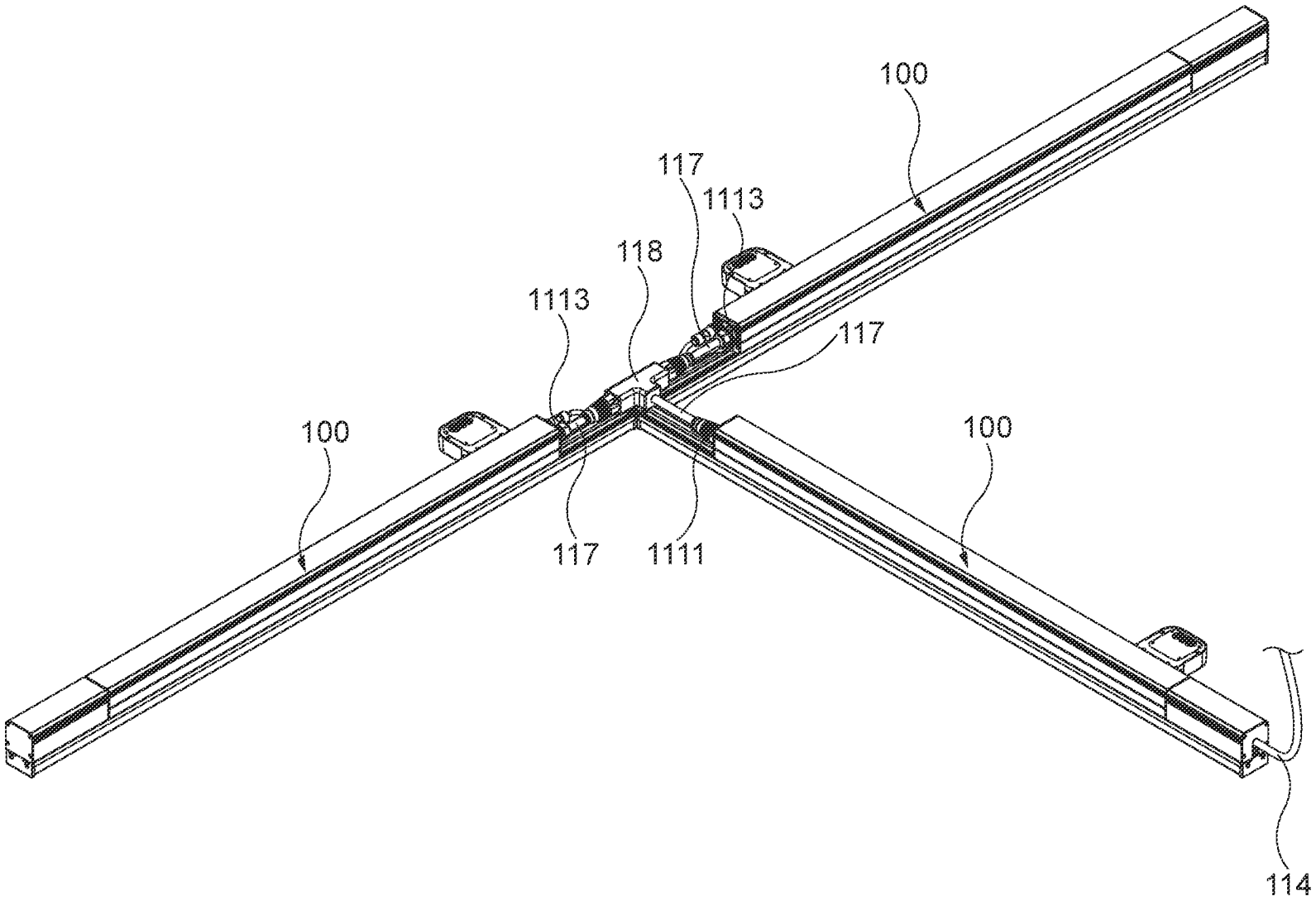
FIG. 8 is a schematic view of a third assembly in accordance with an embodiment of the present invention.

With reference to FIG. 8 for a third assembly in accordance with an embodiment of the present invention, at least three sets of linear lighting fixtures 100 together with a T-shaped connecting part 118 are assembled and connected, and the second port 1113 of one set of linear lighting fixture 100 is coupled to the second connector 114 of the external power, and the quick plug port 1111 is coupled to one of the ends of the T-shaped connecting part 118 by the quick plug connector 117, and the second ports 1113 of the remaining two sets of linear lighting fixtures 100 are coupled to the remaining two ends of the T-shaped connecting part 118 by the quick plug connector 117 separately to conduct the electric power of the three sets of linear lighting fixtures 100, so as to show a T-shaped light source.

Figure 9:
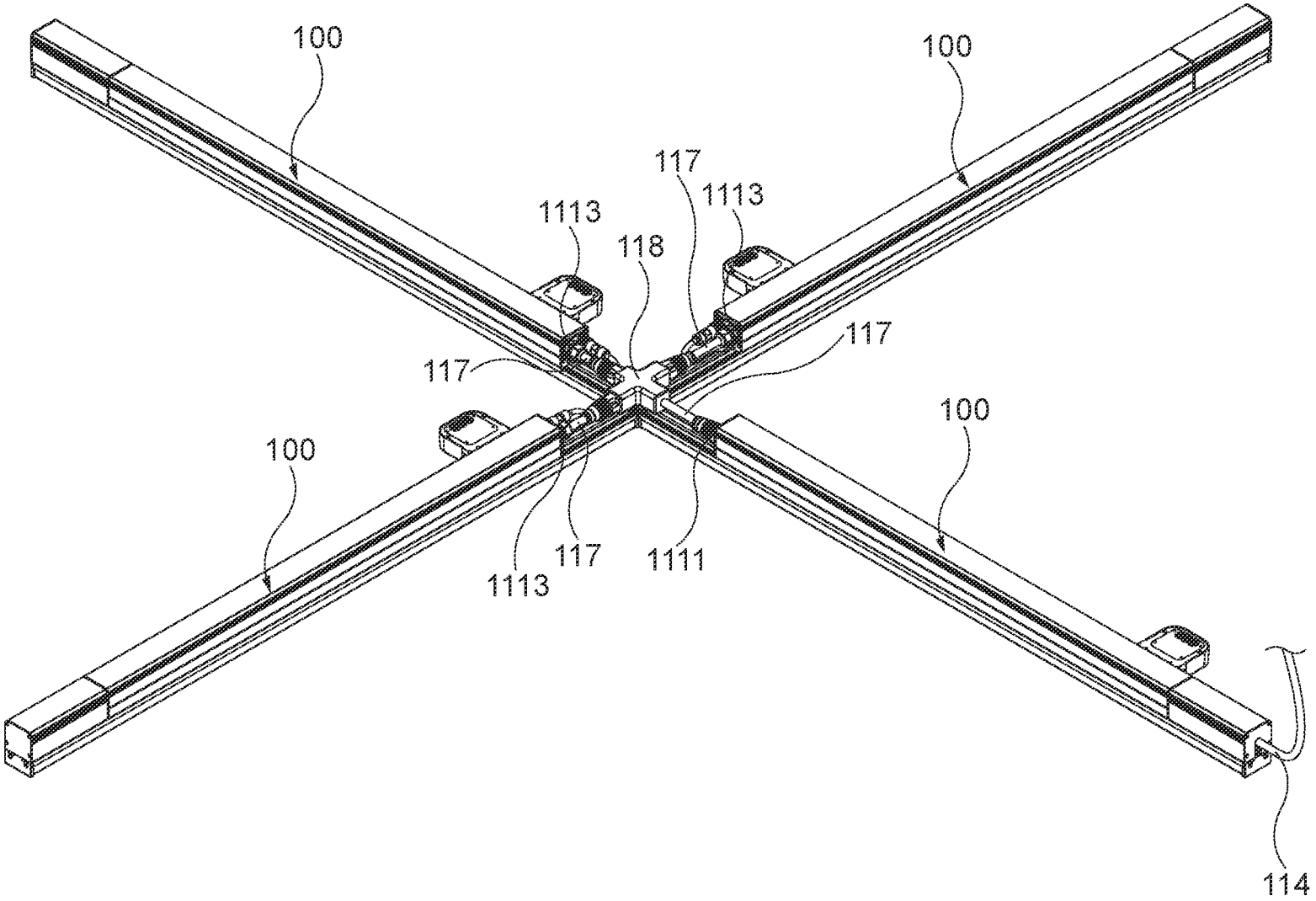
FIG. 9 is a schematic view of a fourth assembly in accordance with an embodiment of the present invention.

With reference to FIG. 9 for a fourth assembly in accordance with an embodiment of the present invention, at least four sets of linear lighting fixtures 100 together with an X-shaped connecting part 118 are assembled and connected, and the second port 1113 of one set of linear lighting fixture 100 is coupled to the external power by the second connector 114, and the quick plug port 1111 is coupled to one of the ends of the X-shaped connecting part 118 by the quick plug connector 117, and the second ports 1113 of the remaining three sets of linear lighting fixtures 100 are coupled to the remaining three ends of the X-shaped connecting part 118 by the quick plug connector 117 separately to conduct the electric power of the four sets of linear lighting fixtures 100, so as to show an X-shaped light source.

Figure 10:
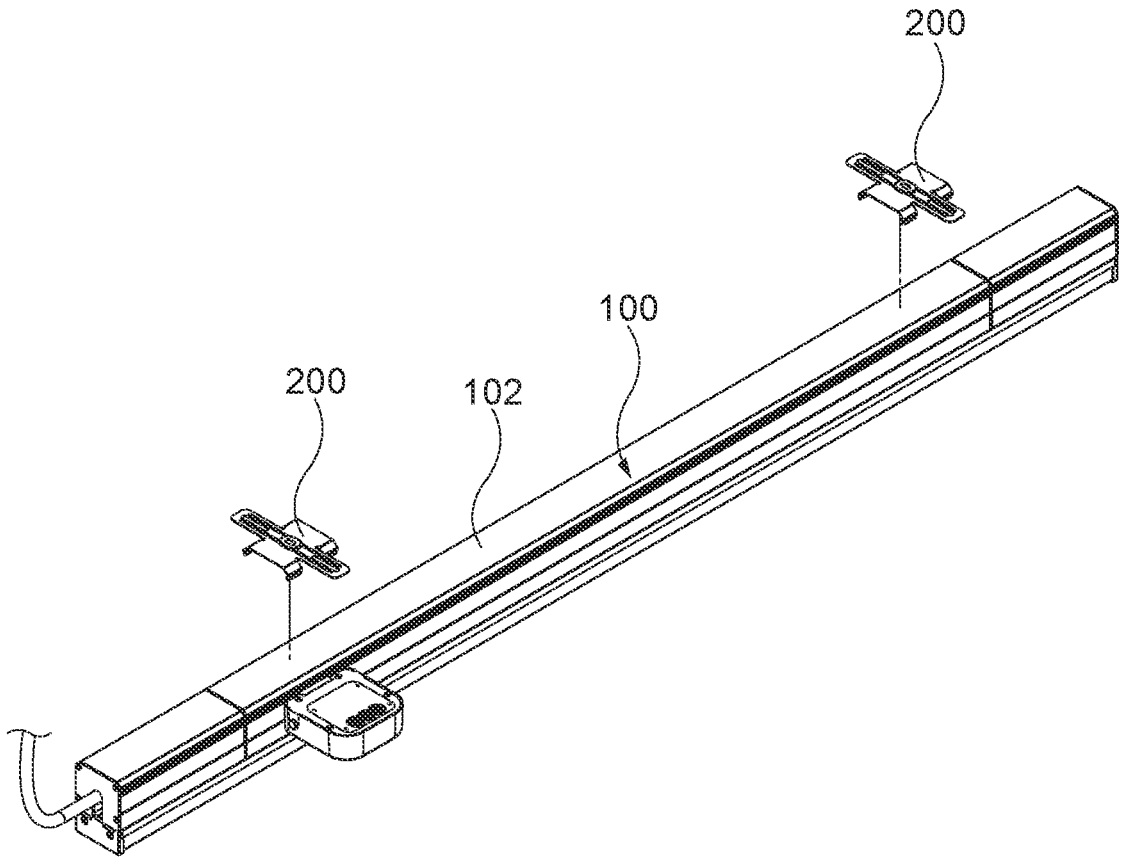
FIG. 10 is a schematic view of the installation of the present invention.
Figure 11:
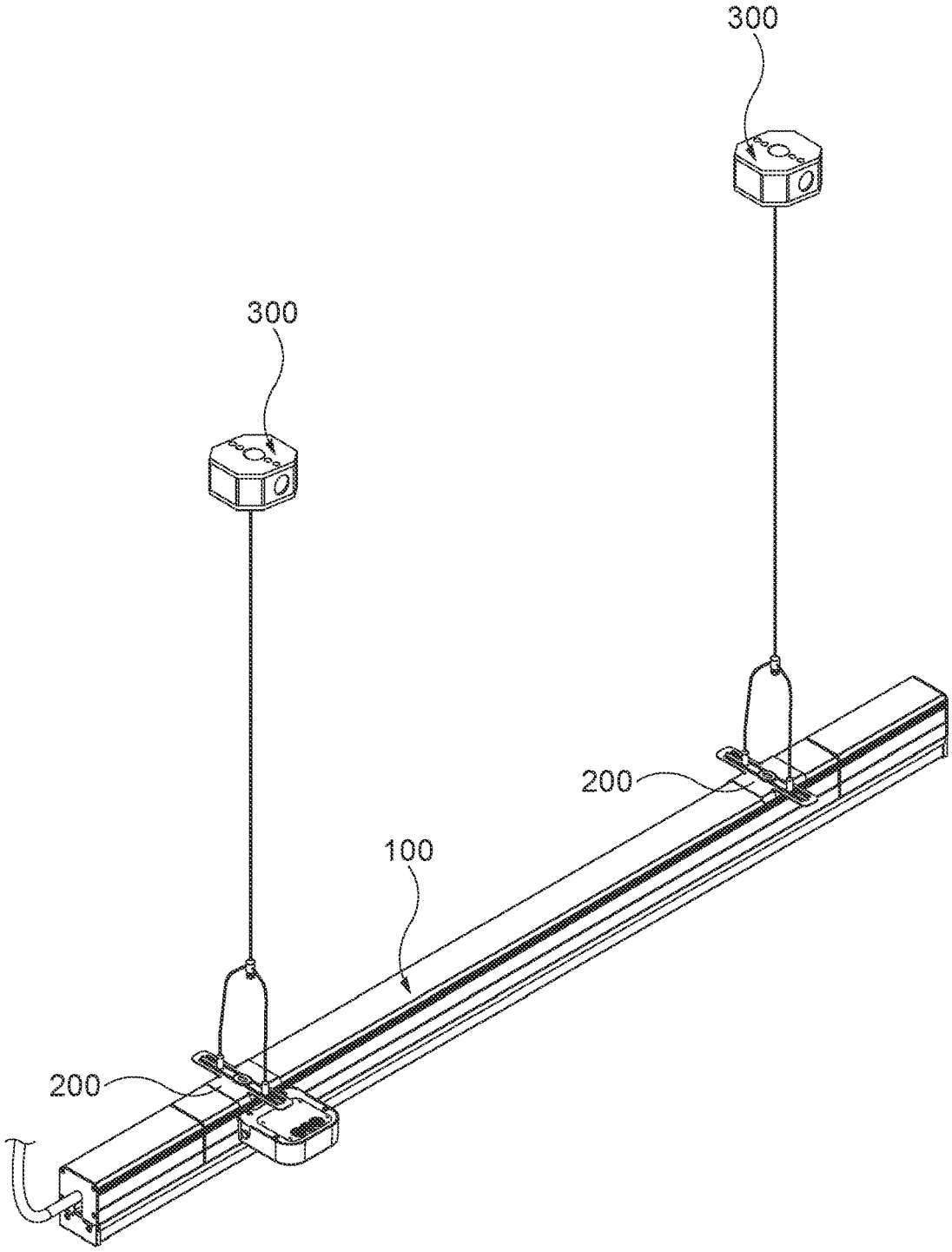
FIG. 11 is a schematic view of a suspended structure of the present invention.
Figure 12:
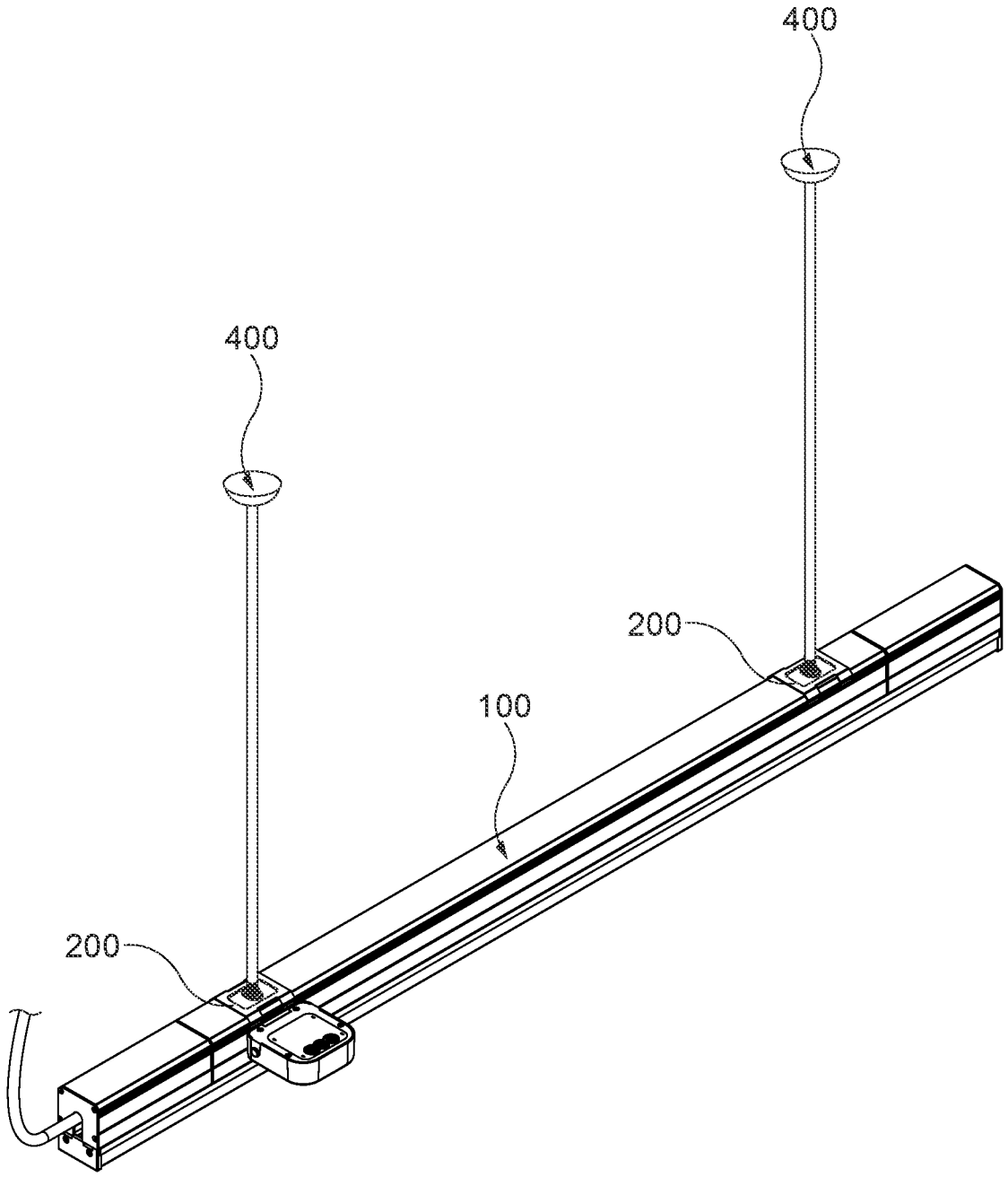
FIG. 12 is a schematic view of a pendant structure of the present invention.

With reference to FIG. 10, the main body 102 of the linear lighting fixture 100 of the present invention can be engaged with at least one clamping member 200, and the clamping member 200 is provided for assembling to a suspended mount assembly 300 (as shown in FIG. 11) or a pendant mount assembly 400 (as shown in FIG. 12) to fit different using requirements by changing the construction and assembling form of the linear lighting fixture 100.

Figure 13:
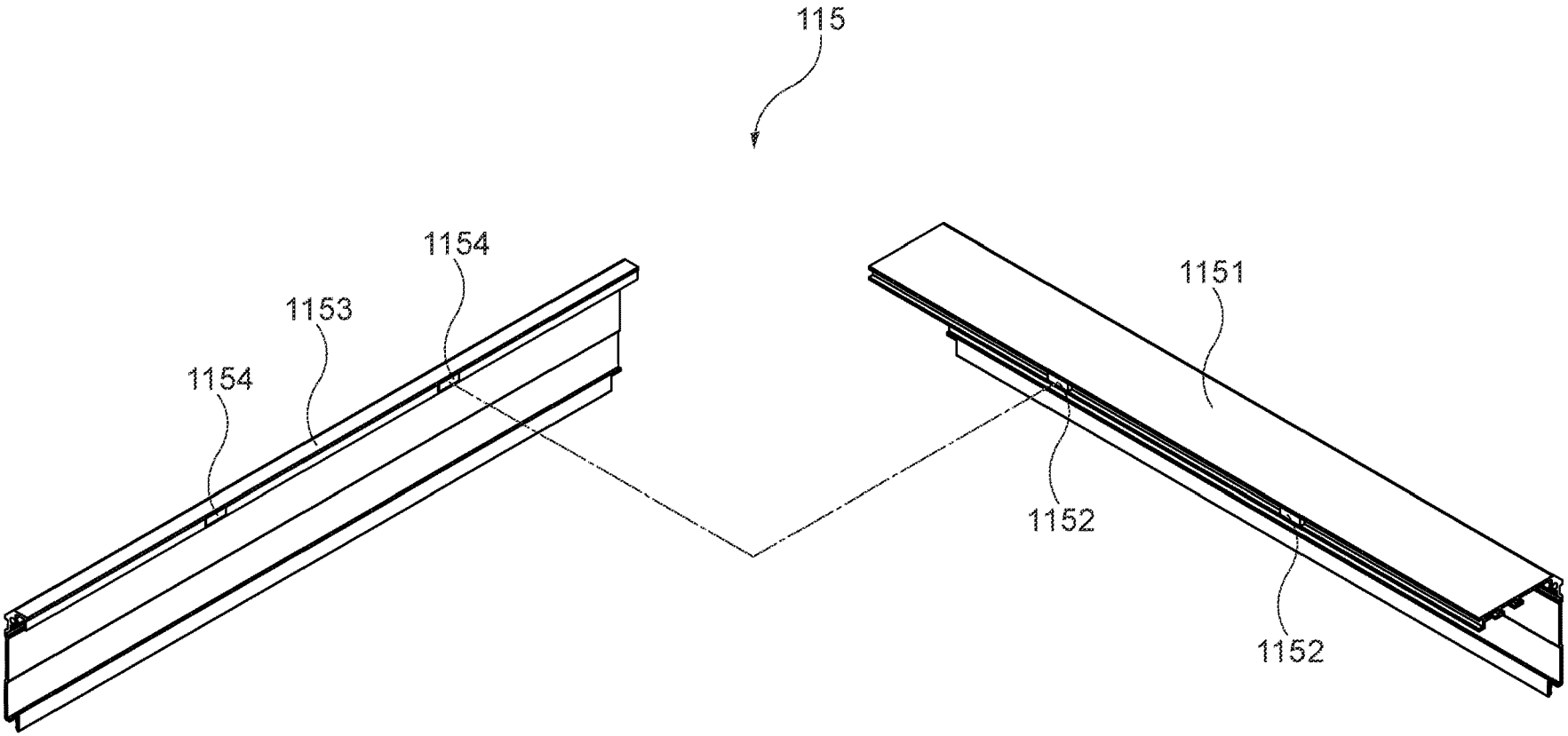
FIG. 13 is an exploded view of an external cover of the present invention.
Figure 14:
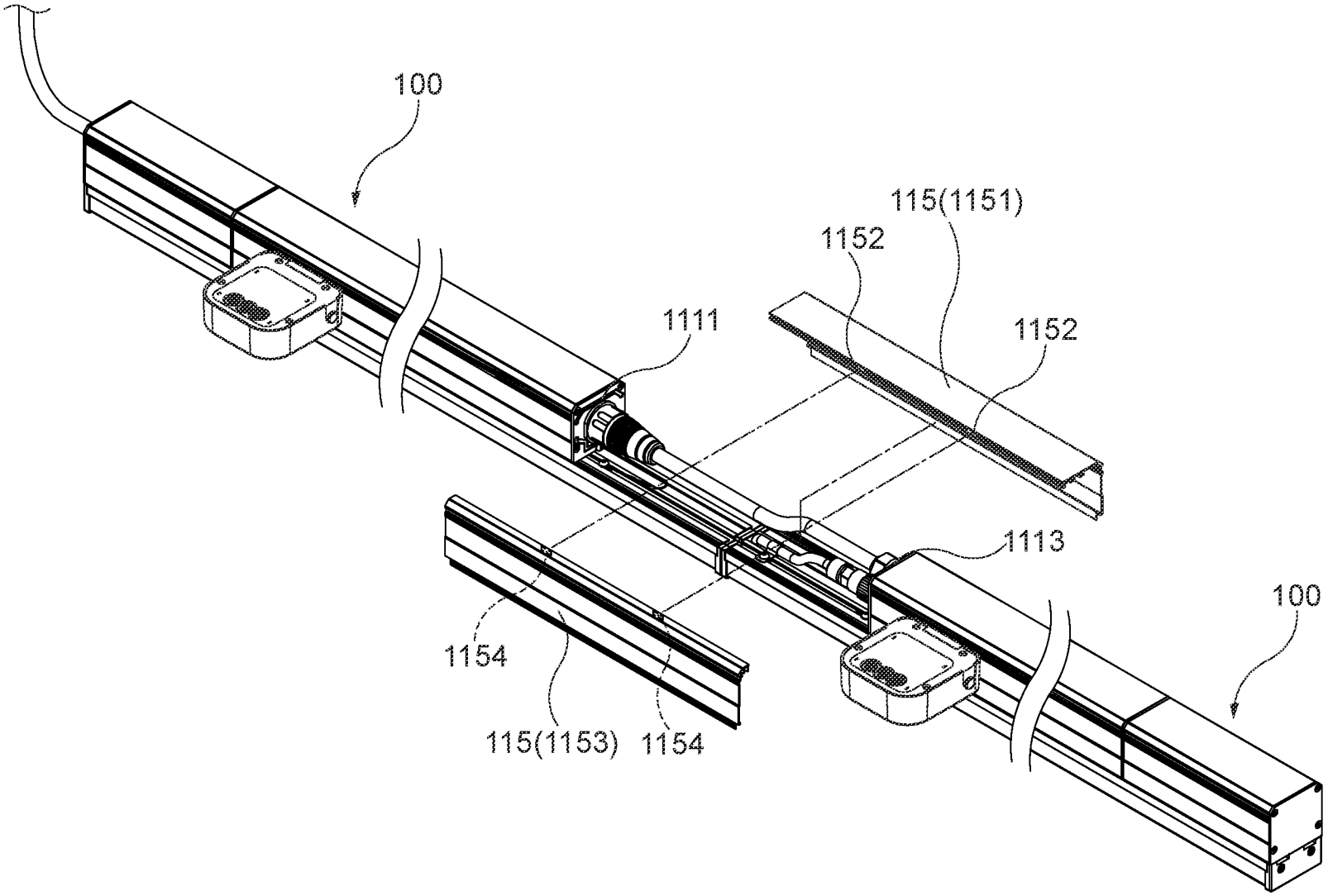
FIG. 14 is a schematic view of using the external cover in accordance with another embodiment of the present invention.

In FIGS. 13 and 14, the external cover 115 provided for covering the joint of the second port 1113 and the quick plug port 1111 of two sets of linear lighting fixtures 100 are formed by combining a first component 1151 with a second component 1153, and a magnet is installed at an end surface of the first component 1151 to form a magnetic part 1152, and a magnet or an iron plate is installed at an end surface of the second component 1153 to form a magnetic part 1154, so that after the two sets of linear lighting fixtures 100 are assembled and coupled, the first component 1151 is embedded into its joint, and the magnetic part 1154 of the second component 1153 and the magnetic part 1152 of the first component 1151 are attracted to each other according to the principle of magnetic attraction, so that the external cover 115 can be assembled and connected quickly without requiring a locking element such as a screw, so as to improve the assembling efficiency.

It is noteworthy that the second side cover 112 of the translucent cover 104 of the linear lighting fixture 100 of the present invention can be made of a translucent material, so that when a linear lighting fixture 100 is assembled and connected to another linear lighting fixture 100, the light source can be continued from the second side cover 112 to avoid a disconnection of light of the connected linear lighting fixture 100.

In the linear lighting fixture 100 of the present invention, the waterproof part 103, the first sealing strip 108 and the second sealing strip 109 installed between the base 101 and the main body 102 are provided for improving the waterproof effect, and the quick plug connectors 117 are provided for connecting the second port 1113 and the quick plug port 1111 of the two sets of linear lighting fixtures 100 in order to assemble and connect a linear lighting fixture 100 to another linear lighting fixture 100 quickly. Several sets of linear lighting fixtures 100 can be assembled and connected to each other to provide an I-shaped, L-shaped, T-shaped or X-shaped light source, so as to improve the practicality of the invention.

What is claimed is:

1. A linear lighting fixture, comprising:

a main body having first side covers secured to opposite ends of the main body by at least one first locking element, the main body defining a main cavity with an opening;

a power supply contained in the main cavity;

a waterproof part coupled to the opening of the main cavity and includes a first sealing strip provided between the waterproof part and the main body;

a base coupled to the waterproof part opposite the main body, the base having second side covers secured to opposite ends of the base by at least one second locking element;

a translucent cover coupled to the base opposite the waterproof part, the translucent cover including a second sealing strip provided between the base and the translucent cover;

a lamp panel disposed on the base facing the translucent cover;

a quick plug port provided on one of the first side covers;

a first port and a second port are formed on the other of the first side covers, the first port electrically coupled to the power supply and the lamp panel by a first connector, and the second port is configured to be coupled to an external power supply or to a quick plug port of the other linear lighting fixture by a quick plug connector.

2. The linear lighting fixture according to claim 1, wherein the waterproof part is aluminum extruded.

3. The linear lighting fixture according to claim 1, wherein the contact surface of the main body and the waterproof part is formed into a concave arc, and the waterproof part has a rib configured to be corresponsive to the concave arc, so that the waterproof part can be embedded into the main body correspondingly.

4. The linear lighting fixture according to claim 1, wherein the lamp panel is an LED lamp panel.

5. The linear lighting fixture according to claim 1, wherein at least two sets of linear lighting fixtures are assembled, and the second portion of one of the sets of linear lighting fixtures is coupled to the second connector of the external power, and the quick plug port is coupled to the second port of the other linear lighting fixture by the quick plug connector to conduct electrical power, so as to show an I-shaped or L-shaped light source according to different orientations of the two sets of linear lighting fixtures.

6. The linear lighting fixture according to claim 1, wherein at least three sets of linear lighting fixtures are assembled, and the second port of one of the sets of linear lighting fixtures is coupled to the second connector of the external power, and the quick plug port is coupled to a T-shaped connecting part by the quick plug connector, and the second ports of the remaining two sets of linear lighting fixtures are coupled to the T-shaped connecting part by the quick plug connector to conduct electrical power, so as to show a T-shaped light source.

7. The linear lighting fixture according to claim 1, wherein at least four sets of linear lighting fixtures are assembled, and the second port of one of the sets of linear lighting fixtures is coupled to the second connector of the external power, and the quick plug port is coupled to an X-shaped connecting part by the quick plug connector, and the second ports of the remaining three sets of linear lighting fixtures are coupled to the X-shaped connecting part by the quick plug connector to conduct electrical power, so as to show an X-shaped light source.

8. The linear lighting fixture according to claim 1, wherein the main body is embeddable in at least one clamping member, and the clamping member is assembled into a suspended mount assembly or a pendant mount assembly to meet user requirements.

9. The linear lighting fixture according to claim 1, wherein the second side cover is made of a translucent material, so that the light source can be continuous without any light disconnection when the linear lighting fixture is coupled to another linear lighting fixture.

10. The linear lighting fixture according to claim 1, wherein the first port, the second port and the quick plug port of the first side cover are covered by an external cover, and the port of the main body which is not coupled to the external cover is secured to an end cover by a locking element.

11. The linear lighting fixture according to claim 10, wherein the external cover includes a first component and a second component, and a magnetic part installed at an end surface coupled to the first component and an end surface coupled to the second component separately.

12. The linear lighting fixture according to claim 11, wherein the magnetic part of each of the first component and the second component includes magnets attracted to each other.

13. The linear lighting fixture according to claim 11, wherein the magnetic part of each of the first component and the second component includes a magnet and an iron plate respectively.

* * * * *